US005131564A

United States Patent [19]

Plonkey

[11] Patent Number: 5,131,564

[45] Date of Patent: Jul. 21, 1992

[54] DISPENSER APPARATUS FOR DISPOSABLE RAZORS

[76] Inventor: Theodore N. Plonkey, 37990 Hamon, Mt. Clemens, Mich. 48045

[21] Appl. No.: 537,600

[22] Filed: Jun. 14, 1990

[51] Int. Cl.[5] ..... A47F 1/04

[52] U.S. Cl. ..... 221/155; 221/281; 221/308; 221/310; 206/355; 206/485

[58] Field of Search ..... 206/349, 352, 354, 355-360, 206/15.3, 220, 485; 30/40, 40.2, 86, 90; 221/281, 307, 308, 309, 310, 155, 102

[56] References Cited

U.S. PATENT DOCUMENTS

| | | | |
|---|---|---|---|
| 1,165,702 | 12/1915 | Nilsson | 221/307 |
| 4,140,244 | 2/1979 | Claddy | 221/281 |
| 4,141,445 | 2/1979 | Korich | 206/354 |
| 4,664,291 | 5/1987 | Gunderson | 221/310 |
| 4,721,208 | 1/1988 | Thorpe | 206/485 |
| 4,858,784 | 8/1989 | Moddy | 221/281 |

FOREIGN PATENT DOCUMENTS

| | | | |
|---|---|---|---|
| 210667 | 6/1967 | Sweden | 221/309 |

*Primary Examiner*—H. Grant Skaggs
*Attorney, Agent, or Firm*—Gerald R. Black

[57] ABSTRACT

The apparatus stores and dispenses a plurality of disposable razors, the dispenser being affixable to a bathroom wall. The razors are initially loaded into the dispenser apparatus and retained therein by a pair of opposed support members, the support members extending inwardly from a pair of parallel sidewalls, the support members having a centrally disposed channel. The support members are sloped downwardly to facilitate gravitational loading of the individual razors. A flexible member is affixed to each of the support members. The dispenser apparatus has an open bottom, enabling the razors stored therewithin to be withdrawn in the same sequence that they are loaded thereinto. The opposed sidewalls of the dispenser apparatus are transparent, enabling the razors stored therewithin to be readily viewed. The dispenser apparatus also includes a razor holder mounted on the top thereof, to retain the razor currently being used.

15 Claims, 2 Drawing Sheets

DISPENSER APPARATUS FOR DISPOSABLE RAZORS

BACKGROUND OF THE INVENTION

1. Field of the Invention

The present invention relates to a dispenser apparatus that is affixable to a wall, within which a plurality of disposable razors may be retained and individually withdrawn therefrom.

2. Background Art

In conventional shaving systems, the same razor is used for many months or years and the blade is replaced as necessary. Hence, the consumer need only purchase a package of razor blades which are compact and conveniently stored, and uses them as needed.

With the introduction of disposable razors, the entire razor is disposed of after the blade has worn out. As with conventional shaving systems, the blade is used several times until it becomes dull. However, unlike conventional shaving systems, the entire razor is disgarded, and replaced. Currently, these disposable razors are sold in a clear plastic package, in which the razors are stored in the linen closet of the bathroom.

U.S. Pat. No. 4,043,035 discloses a container for disposable blade cartridges, the container securely retaining a cartridge in place, enabling the cartridge to be loaded within the razor handle, the dispenser including a spring which brings the next cartridge into position after the preceding cartridge has been loaded.

U.S. Pat. No. 4,445,610 and U.S. Pat. No. 4,266,664 both relate to packaging for a plurality of disposable razors, the packaging generally being space efficient, presenting an attractive display for marketing purposes, and being inexpensive to produce.

U.S. Pat. No. 4,140,244 (Clabby) discloses three separate embodiments of a dispenser for disposable razors, one embodiment designed specifically for secure mounting to a bathroom wall. The razors are loaded into the dispenser via an entranceway, and the razors gravitate downwardly to force the next adjacent razor into a dispensing position.

U.S. Pat. No. 4,450,980 (Clabby) also discloses three separate embodiments of a dispenser for disposable razors. This patent was necessitated by difficulty in manufacturing the device disclosed in the prior Clabby patent, which is also not amenable to machine loading. This patent is an improvement to U.S. Pat. No. 4,140,244 (Clabby), the improvement involving a backing member to enable easy replacement of the dispenser.

What is needed is an dispenser apparatus for storing these disposable razors, that is readily affixable to a bathroom wall, that is easy to load with the disposable razors, that enables each razor to be readily withdrawn therefrom, that enables the user to regularly inventory the number of razors, that is attractive in appearance, and that is compact in design.

The advantages listed above, together with other advantages, will be readily apparent to those skilled in the art, as such advantages are inherent in the present invention as hereinafter described and claimed, and as depicted in the accompanying drawings.

SUMMARY OF THE INVENTION

The invention is an dispenser apparatus for storing a plurality of disposable razors, the dispenser apparatus being affixable to a bathroom wall. The razors are initially loaded into the dispenser onto two opposed support members. The opposed support members extend inwardly from two opposed surface members. The support members are preferably sloped downwardly to facilitate the gravitational loading of the razors. The dispenser apparatus preferably has an open bottom, enabling the razors to be individually withdrawn from the dispenser apparatus in the same sequence in which they were loaded thereinto.

For a more complete understanding of the dispenser apparatus and the method of using the dispenser apparatus of the present invention, reference is made to the following detailed description and accompanying drawings in which the presently preferred embodiments of the invention are illustrated by way of example. As the invention may be embodied in several forms without departing from the spirit or essential characteristics thereof, it is expressly understood that the drawings are for purposes of illustration and description only, and are not intended as a definition of the limits of the invention. Throughout the description and drawings, like reference numbers refer to the same component throughout the several views.

DETAILED DESCRIPTION OF THE PREFERRED EMBODIMENTS

Figure 1:
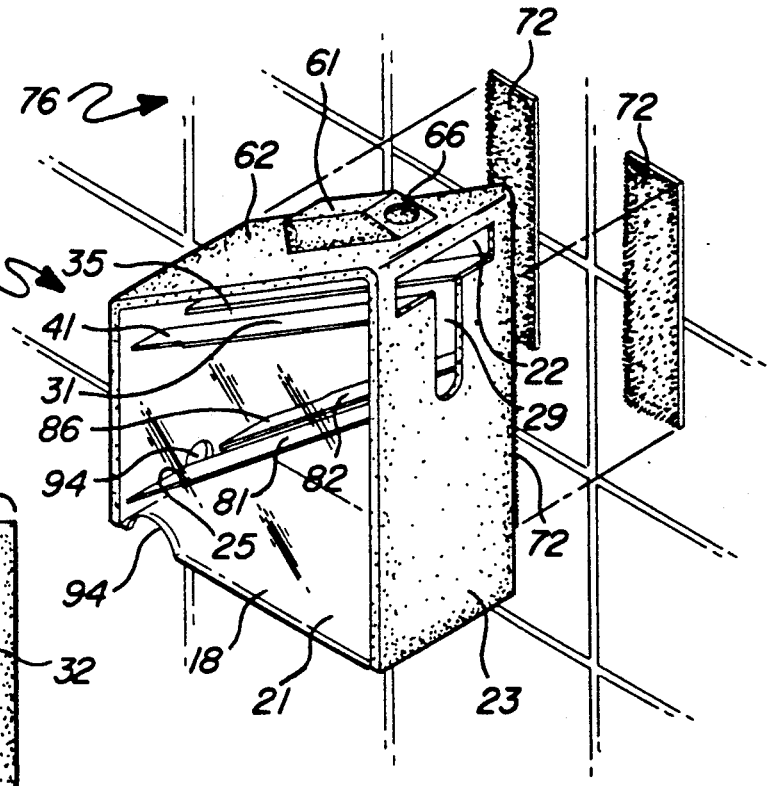
FIG. 1 is a perspective view of the preferred embodiment of the dispenser apparatus of the present invention.

Referring now to the drawings, the preferred embodiment dispenser apparatus 10 of the present invention is disclosed in FIG. 1. The dispenser apparatus 10 preferably includes two surface members 21 and 22 (one of which is affixable to a bathroom wall 76), two support members 31 and 32 which support the heads 53 of the razors 51 positioned therewithin, and two flexible members 41 and 42 (withdrawing means) which enable the razors 51 to be individually withdrawn therefrom.

The dispenser apparatus 10 preferably is an enclosure 12 which substantially surrounds and encases both the heads 56 and the handles 58 of the razors 51 stored therewithin. The enclosure 12 comprises a pair of opposed surface members 21 and 22 (or sidewalls), and an adjoining member 23 attaching the sidewalls 21 and 22 together. An enclosure 12 is preferred for safety purposes for storing and handling the razors 51. Accordingly, if the dispenser apparatus 10 is to be an enclosure 12, at least one of the surface members is larger than one of the razors 51. The sidewalls 21 and 22 and the adjoining member 23 have a plurality of notches 26 disposed at the bottom thereof to make it easier to grasp the handle 58 of the first razor 51.

The dispenser apparatus 10 includes two support members 31 and 32, each of which protrude inwardly from one of the sidewalls 21 and 22. The two support members 31 and 32 preferably have a channel 35 centrally disposed therebetween, the head 53 of the razors 51 being supportable upon the support members 31 and 32. The two support members 31 and 32 are preferably secured to the two sidewalls 21 and 22 at a downward slope to facilitate the razors to be gravitationly loaded, the angle being between 15 and 30 degrees.

Figure 2:
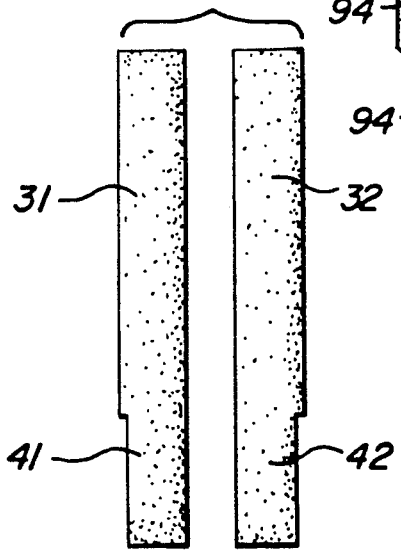
FIG. 2 is a detail view of the pair of flexible members depicted in FIG. 1, with the channel disposed therebetween.
Figure 5A:
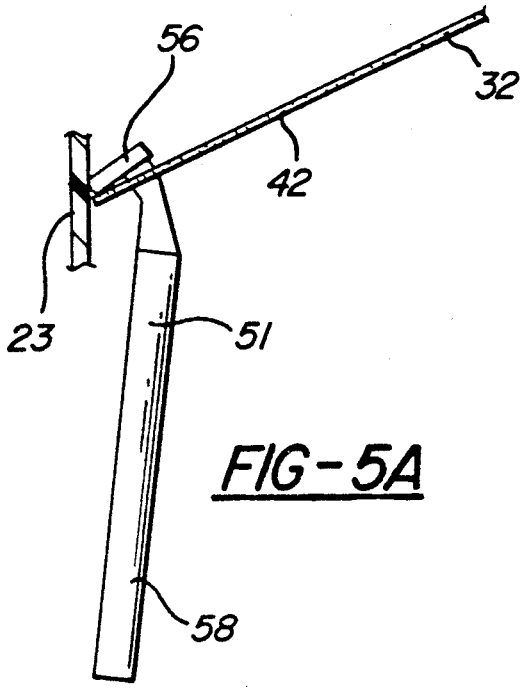
FIG. 5A is a simplified perspective view of flexible members of the present invention as depicted in FIG. 1 or FIG. 4 in the unstressed state.
Figure 5B:
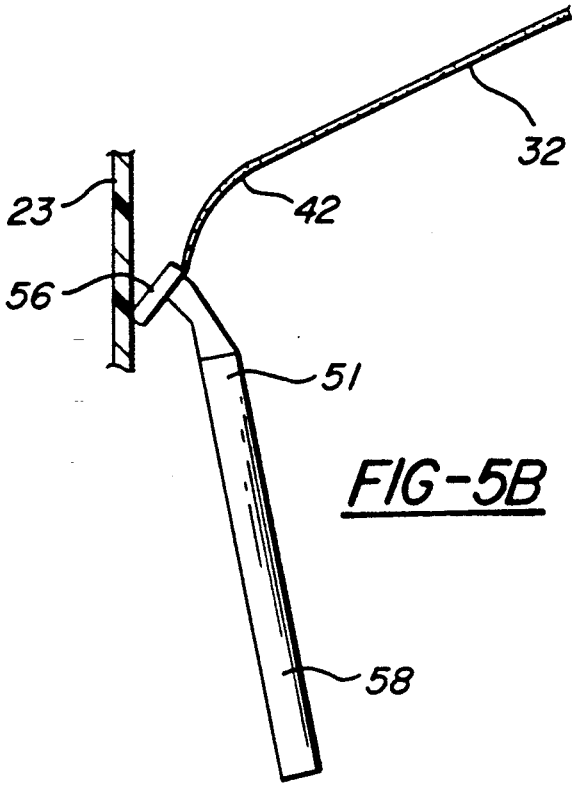
FIG. 5B is a simplified perspective view of the flexible members of the present invention as depicted in FIG. 1 or FIG. 4 in the stressed state.
Figure 4:
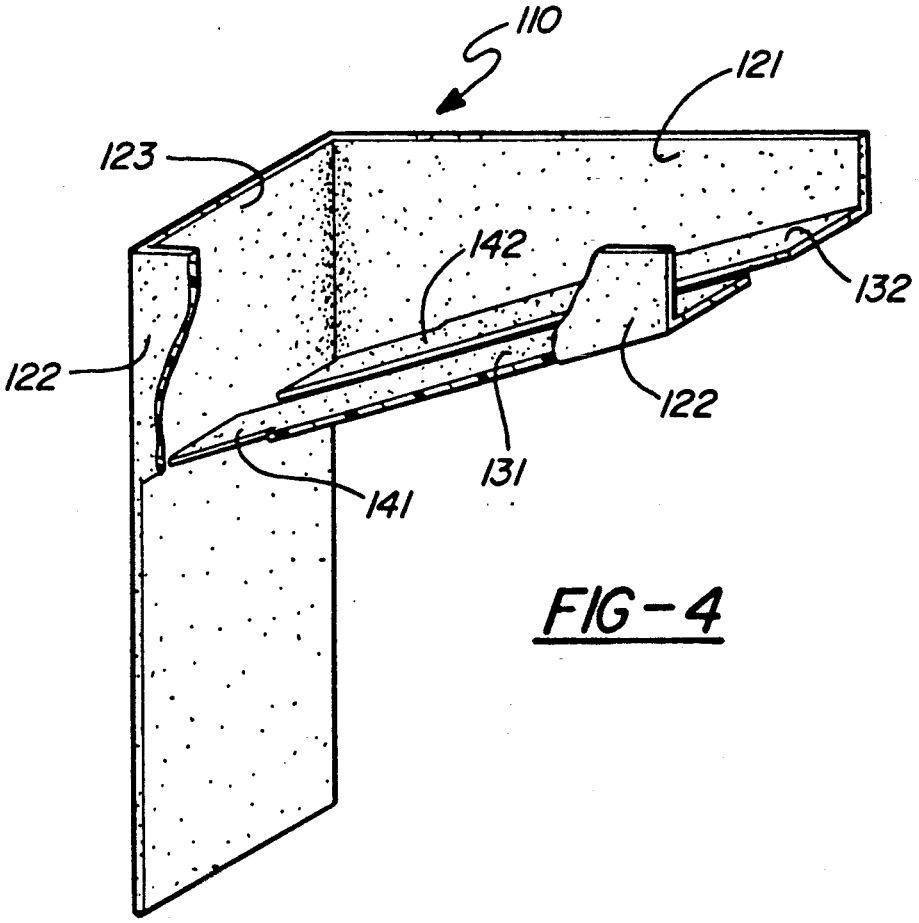
FIG. 4 is a cut-away perspective view of a second embodiment of the dispenser apparatus of the present invention.

The dispenser apparatus 10 also includes two flexible members 41 and 42 which enable the razors 51 to be individually withdrawn therefrom in the same sequence that the razors 51 are loaded thereinto. The flexible members 41 and 42 have a stressed position (see FIG. 5A) and an unstressed position (see FIG. 5B). When the two flexible members 41 and 42 are in the unstressed position, the heads 56 of the razors 51 are supported thereon. When the two flexible members 41 and 42 are in the stressed position, the first razor 51 can be withdrawn therefrom while the two flexible members 41 and 42 still retain the second razor 52. Each flexible member 41 and 42 extends from one of the support members 31 and 32 (see FIG. 2), and the distance between the edge 45 of the flexible members 41 and 42 and the adjoining member 23 is of sufficient size so as to retain a razor 51 therebetween when the flexible members 41 and 42 are in the unstressed position. The flexible members 41 and 42 are made of a suitable plastic material, and are not secured to the sidewalls 21 and 22.

The dispenser apparatus 10 preferably includes a protruding member 61 (separate securing means) externally disposed upon the upper surface member 62. The protruding member 61 enables a single razor 53 to be retained therewithin (the razor currently being stored for reuse). The protruding member 61 has an opening 66 centrally disposed therewithin, the opening 66 being slightly larger than the handle of one of the razors 51, thereby enabling the handle 58 to be retained therewithin.

Figure 3:
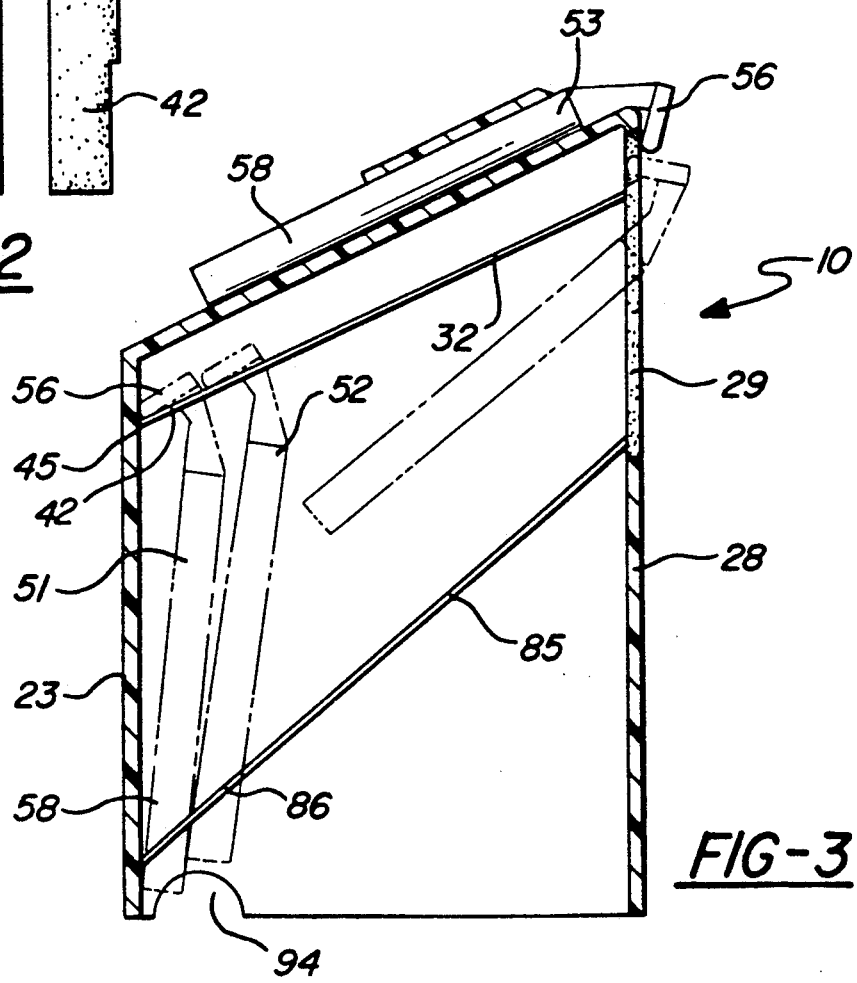
FIG. 3 is a cut-away view of the dispenser apparatus depicted in FIG. 1.

The razors 51 are loaded into the dispenser apparatus 10 as depicted in FIG. 3 through a generally T-shaped cut-away portion 29 disposed within the loading surface member 28 (see FIG. 1).

The dispenser apparatus 10 preferably includes an open bottom portion 18, the open bottom portion 18 enabling the first razor 51 to be withdrawn therefrom by grasping the handle 58 of the first razor 51 and applying a downward force thereto.

The dispenser apparatus 10 is generally affixable to a bathroom wall 76 by either a plurality of fasteners (not shown), or by a plurality of strips of hook and loop fasteners 72. The dispenser apparatus 10 is preferable symmetrical about a longitudinal plane bisecting the dispenser apparatus 10, thereby enabling the dispenser apparatus 10 to be affixed to the bathroom wall 76 in such a manner as to accommodate either a left-handed or a right-handed person. The strips of hook and loop fasteners 72 are preferred since the strips 72 can be readily glued to either sidewall 21 or 22, thereby enabling adaption of the dispenser apparatus 10.

The dispenser apparatus 10 preferably includes a second pair of flexible members 85 and 86 extending from a second pair of support members 81 and 82, respectively. The second pair of support members 81 and 82 extend inwardly from the opposed sidewalls 21 and 22. The second pair of flexible members 85 and 86 are primarily for purposes of safety to make the dispenser apparatus 10 more difficult for a child to extract a razor 51 therefrom. The second pair of flexible members 85 and 86 are disposed beneath the first pair of flexible members 41 and 42. The angle of the second pair of flexible members 85 and 86 is preferably at a steeper incline (between 30 and 50 degrees) than the first pair of flexible members 41 and 42. Several notches 94 conveniently disposed at the bottom of the surface members 21 and 22 make it easier to grasp the handle 58 of the razor 51.

Preferably, the opposed sidewalls 21 and 22 of the dispenser apparatus 10 are transparent enabling the plurality of razors 51 disposed therewithin to be readily viewed.

A second embodiment of the dispenser apparatus 110 is depicted in FIG. 5. In this embodiment, the dispenser apparatus 110 comprises only two sidewalls 121 and 122 and an adjoining member 123, and two flexible members 141 and 142 extending from the two support members 131 and 132, the two support members 131 and 132 each extending inwardly from one of the sidewalls 121 and 122.

While the dispenser apparatus and the method of using the dispenser apparatus of the present invention have been described in conjunction with specific embodiments, it is evident that many alternatives, modifications, and variations will be apparent to those skilled in the art in light of the disclosure herein. It is intended that the metes and bounds of the invention be determined by the appended claims rather than by the language of the above specification, and that all such alternatives, modifications, and variations which form a functional or conjointly cooperative equivalent are intended to be included within the spirit and scope of these claims.

I claim

1. An apparatus for retaining therewithin first and second razors each having a head and a handle, the apparatus being generally affixable to a wall, the apparatus comprising:

(a) a first surface member being positioned opposite to a second surface member by an adjoining member, the surface members and the adjoining member combining to substantially encase the head and the handle of the first and second razors positionable therewithin;

(b) a first and second support members each extending from one of the two opposed surface members, the first and second support members each protruding inwardly from one of the two opposed surface members, the heads of the first and second razors resting upon and being supported by the first and second support members; and (c) a first and second flexible members enabling the withdrawal of the first razor from the first and second support members while the second razor is still securely retainable thereon, the first flexible member extending from the first support member, the second flexible member extending from the second support member, the first and second flexible members having a channel disposed therebetween, the first and second flexible members having a stressed position and an unstressed position.

2. The apparatus of claim 1, wherein the first and second support members have a channel disposed therebetween, the first and second support members having a slope that is non-vertical.

3. The apparatus of claim 1, wherein the first and second flexible members are in the unstressed position when the heads of the first and second razors are disposed thereon, and when the first and second flexible members are in the stressed position the first razor can be withdrawn therefrom while the first and second flexible members still retain thereon the head of the second razor.

4. The apparatus of claim 1, wherein the apparatus includes an open bottom portion which enables the first razor to be withdrawn therethrough by grasping the handle of the first razor and applying a downward force thereto.

5. The apparatus of claim 1, further comprising a third and fourth flexible members disposed beneath the first and second flexible members, the third and fourth flexible members each protruding inwardly from one of the two opposed sides of the surface members, the third and fourth flexible members having a channel disposed therebetween.

6. The apparatus of claim 1, wherein one of the surface members is transparent.

7. The apparatus of claim 1, further comprising separate means for securing a third razor, the separate securing means being disposed onto an external side of one of the surface members.

8. An apparatus for retaining therewithin first and second razors each having a head and a handle, the apparatus being generally affixable to a wall, the apparatus comprising:

(a) a first surface member being retained opposite a second surface member by an adjoining member; and (b) a first support member protruding inwardly from the first surface member, a second support member protruding inwardly from the second surface member, the first and the second support members having a channel disposed therebetween, the heads of the first and second razors resting upon and being supported upon the first and second support members, a first flexible member extending from the first support member and a second flexible member extending from the second support member, the first and second flexible members having a channel disposed therebetween, the first and second flexible members having a stressed position and an unstressed position.

9. The apparatus of claim 8, further comprising means for withdrawing the first razor from the first and second support members while the second razor is still securely retainable thereon, the first razor being loadable onto the first and second support members prior to the second razor, and the first razor being withdrawable from the first and second support members prior to the second razor by applying a downward support members prior to the second razor by applying a downward force to the handle of the first razor.

10. The apparatus of claim 8, wherein the first and second razors are capable of being substantially enclosed within the plurality of surface members and the adjoining member.

11. The apparatus of claim 8, wherein the first and second support members have a slope that is non-vertical.

12. The apparatus of claim 8, wherein the apparatus includes a substantially open bottom portion enabling the handles of the first and second razors to be positioned from underneath the support members.

13. The apparatus of claim 8, further comprising a third and fourth flexible members disposed beneath the first and second flexible members.

14. The apparatus of claim 8, further comprising separate means for securing a third razor, the separate securing means being disposed onto an external surface member.

15. A method for storing first and second razors within an apparatus that is affixable to a wall, the apparatus including a first and second flexible members enabling the individual loading and withdrawal of the first and second razors, the first flexible member extending from a first support member, the second flexible member extending from a second support member, the first and second flexible members having a stressed and an unstressed position, the first and second flexible members being in the unstressed position when the heads of the first and second razors are disposed thereon, the first and second flexible members being in the stressed position when the first razor is withdrawn therefrom, the first and second razors each having a head and a handle, the method comprising:

(a) loading the first razor into the apparatus, the head of the first razor being restable and supportable upon the two support members disposed within the apparatus, a channel being disposed between the two support members;

(b) loading the second razor into the apparatus, the head of the second razor being retainably disposed behind the first razor; and (c) withdrawing the first razor from the apparatus by applying a downward force to the handle of the first razor while the second razor is still retainably disposed within the apparatus.

* * * * *